US012209826B2

(12) United States Patent
Soljacic et al.

(10) Patent No.: US 12,209,826 B2
(45) Date of Patent: Jan. 28, 2025

(54) PASSIVE RADIATIVE COOLING DURING THE DAY

(71) Applicant: MASSACHUSETTS INSTITUTE OF TECHNOLOGY, Cambridge, MA (US)

(72) Inventors: Marin Soljacic, Belmont, MA (US); Evelyn Wang, Cambridge, MA (US); Yichen Shen, Cambridge, MA (US); Bikramjit Bhatia, Cambridge, MA (US); Arny Leroy, Cambridge, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 1134 days.

(21) Appl. No.: 16/460,683

(22) Filed: Jul. 2, 2019

(65) Prior Publication Data

US 2020/0025468 A1 Jan. 23, 2020

Related U.S. Application Data

(60) Provisional application No. 62/693,229, filed on Jul. 2, 2018.

(51) Int. Cl.

| | |
|---|---|
| ***F28F 9/20*** | (2006.01) |
| ***F24F 5/00*** | (2006.01) |
| ***F25B 23/00*** | (2006.01) |
| ***F28F 13/18*** | (2006.01) |

(52) U.S. Cl.

CPC ..... *F28F 9/20* (2013.01); *F24F 5/0046* (2013.01); *F24F 5/0089* (2013.01); *F28F 13/18* (2013.01); *F24F 2005/0064* (2013.01); *F25B 23/003* (2013.01); *F28F 2245/06* (2013.01)

(58) Field of Classification Search

CPC ..... F28F 9/20; F28F 13/18; F28F 2245/06; F24F 5/0046; F24F 5/0089; F25B 23/003

USPC ..... 250/504 R

See application file for complete search history.

(56) References Cited

U.S. PATENT DOCUMENTS

| | | | | |
|---|---|---|---|---|
| 9,927,188 | B2 * | 3/2018 | Liu | F28F 3/00 |
| 10,591,190 | B2 * | 3/2020 | Yoshihiro | F25D 31/00 |
| 10,736,244 | B1 * | 8/2020 | Lin | H05K 7/20963 |
| 11,360,249 | B2 * | 6/2022 | Yasuda | G02B 5/26 |
| 2005/0167612 | A1 * | 8/2005 | Jaffer | F25B 23/003 250/458.1 |
| 2014/0131023 | A1 * | 5/2014 | Raman | B64G 1/50 165/185 |
| 2016/0362807 | A1 * | 12/2016 | Casse | F28F 13/185 |
| 2019/0257557 | A1 * | 8/2019 | Yoshizawa | F17C 3/08 |

* cited by examiner

*Primary Examiner* — Jon T. Schermerhorn, Jr.
(74) *Attorney, Agent, or Firm* — Nields, Lemack & Frame, LLC

(57) ABSTRACT

A radiative cooling device can include a reflector positionable to permit operation during daylight hours.

20 Claims, 21 Drawing Sheets

C b b b

PASSIVE RADIATIVE COOLING DURING THE DAY

CLAIM OF PRIORITY

This application claims priority to U.S. Provisional Application No. 62/693,229, filed Jul. 2, 2018, which is incorporated by reference in its entirety.

STATEMENT REGARDING FEDERALLY SPONSORED RESEARCH

This invention was made as part of the Solid-State Solar Thermal Energy Conversion (S3TEC) Center, an Energy Frontier Research Center funded by the U.S. Department of Energy, Office of Science, Basic Energy Sciences under Award No. DE-SC0001299/DE-FG02-09ER46577. The Government has certain rights in the invention.

FIELD OF THE INVENTION

The invention relates to a passive radiative cooling device and methods of improving performance of a device.

BACKGROUND

Air conditioning and refrigeration constitute a significant portion of our energy needs. Passive approaches exploiting high atmospheric transparency in mid-infrared wavelengths (8-13 μm) to cool terrestrial objects by radiating heat to the low temperature upper atmosphere offer a promising low-cost refrigeration solution. Few recent studies have demonstrated passive daytime radiative cooling to below ambient temperatures by using spectrally selective photonic crystal emitters. See, for example, A. P. Raman, M. A. Anoma, et al., *Nature,* 515, 540 (2014) and L. Zhu, A. P. Raman and S. Fan, *PNAS,* 112, 12282 (2015), each of which is incorporated by reference in its entirety.

SUMMARY

In one aspect, a radiative cooling device can include an emitter in thermal communication with atmosphere and a reflector that substantially blocks direct solar radiation from the emitter.

In another aspect, a method of radiative cooling can include providing an emitter in thermal communication with atmosphere and positioning a reflector to substantially blocks direct solar radiation from the emitter.

In certain circumstances, the emitter can be enclosed in a housing having an opening, the opening having a cover.

In certain circumstances, the cover can be partially transparent in an atmospheric wavelength transparency window and partially reflective in a solar wavelength window, thereby minimizing heat gain due to diffuse solar radiation.

In certain circumstances, the cover can be partially transparent in an atmospheric wavelength transparency window and partially reflective in a solar wavelength window, thereby minimizing heat gain due to diffuse solar radiation.

In certain circumstances, the cover can include a nanoporous polyolefin.

In certain circumstances, the emitter can be partly absorbing in the solar wavelength spectrum.

In certain circumstances, the emitter can be partly reflecting in the solar wavelength spectrum.

In certain circumstances, the reflector can be a disc.

In certain circumstances, the reflector can be a band.

In certain circumstances, the disc can be positioned in a first dimension and a second dimension relative to the emitter based on the location of the sun.

In certain circumstances, the band can be positioned in a first dimension relative to the emitter based on the location of the sun.

Other aspects, embodiments, and features will be apparent from the following description, the drawings, and the claims.

BRIEF DESCRIPTION OF THE DRAWINGS

FIG. 7A depicts conjugate conduction and natural convection heat transfer model. FIG. 7B depicts steady-state temperature distribution shown for half of the device cross-section. The emitter cooling power is 20 $W/m^2$ and the ambient temperature is 16° C.

FIG. 8A depicts spectral direct-hemispherical reflectance of the polished aluminum fixed reflector, white polyethylene (from a grocery bag) cover and white- and black-painted emitters. FIG. 8B depicts a photograph of the two devices during measurement. FIG. 8C depicts temperature of the solar-white and solar-black emitters measured two hours before and two hours after solar noon. Measured ambient temperature and direct normal irradiance (DNI) and diffuse solar irradiation are also shown for reference. The measurement was done in Cambridge, MA on October.

DETAILED DESCRIPTION

Figure 1A:
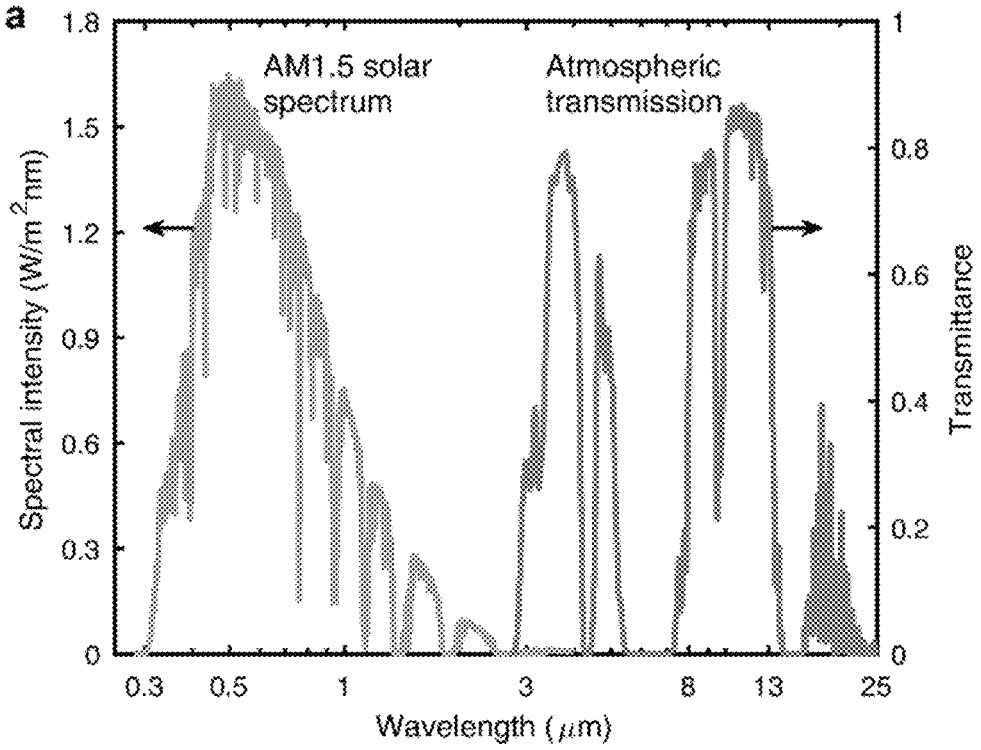
FIG. 1A depicts spectral distribution of solar irradiation (AM1.5G spectrum) and atmospheric transmittance (shown for wavelengths>2.7 μm, Cambridge in October).

Cooling performance of an emitter can be enhanced by decoupling a reflector from the emitter to minimize the effect of solar absorption. This eliminates the biggest bottleneck to the performance of emitters, particularly state-of-art photonic emitters. The simple geometric optics based approach demonstrated in this work could lead to low-cost, high-performance passive radiative cooling solutions. Higher cooling powers of up to 100 $W/m^2$ and minimum temperatures of 17° C. below ambient during daytime are possible using a simple blackbody emitter. Unlike previous work on daytime radiative cooler designs that rely on complex photonic structures we use a polished aluminum reflector, physically separated from the emitter, to reflect the direct solar radiation. In addition, a nanoporous polyethylene membrane can reflect about ~80% of the diffuse solar radiation and can serve as a convection cover. The proof-of-concept radiative cooler was tested under the sun and at night and its performance was analyzed based on the relative contributions of different heat transfer pathways—incoming and outgoing atmospheric radiation, incoming solar irradiation and conduction and convection losses to the surroundings.

The radiative cooling device can include an emitter that emits energy at wavelengths for which the atmosphere is relatively transparent. The emitter can be an infrared-emitting body. For example, the emitter can emit at wavelengths greater than 3 micrometers, for example between 3 micrometers and 13 micrometers. The emitter can be in a housing having a cover between the emitter and the atmosphere or sky. The cover can be substantially transparent to wavelengths emitted by the emitter.

The emitter can be a metal, for example, copper, having a coating. The coating can be partly solar reflecting or partly solar absorbing coating, for example, white or black paint.

The cover can be a polyolefin, for example, a polyethylene.

The housing can include a reflective surface surrounding an opening that includes the cover. The emitter can be thermally isolated from the housing.

A reflector can be decoupled from the emitter by positioning the reflector to block solar irradiation from substantially directly contacting the emitter. The reflector can be in a moveable position relative to the emitter so that it can be oriented to block solar radiation. Alternatively, the reflector can be dynamically positioned according to a solar tracking or time and position algorithm.

The device configuration can generate a maximum cooling power of more than 50, more than 60, more than 70 or more than 80 $W/m^2$. The device configuration can generate a temperature of more than 5, more than 8, more than 10, more than 15, or more than 20° C. below ambient temperature.

Passive cooling by exploiting the high atmospheric transparency in mid-infrared (IR) wavelengths (8-13 μm) and radiating heat to the low temperature upper atmosphere promises a low-cost refrigeration solution. While past work has demonstrated this concept, it has primarily relied on complex and costly spectrally selective photonic structures with high emissivity in the transparent atmospheric spectral window and high reflectivity in the solar spectrum. Here, a directional approach to passive radiative cooling is shown that exploits the angular confinement of solar irradiation in the sky to achieve sub-ambient cooling during the day regardless of the emitter properties in the solar spectrum. This approach is demonstrated using a setup comprising a polished aluminum disk that reflects direct solar irradiation and a white infra-red transparent polyethylene layer (convection cover) that minimizes diffuse solar irradiation as well as serves as an IR-transparent convection cover. Measurements performed around solar noon using solar-white and solar-black emitters show a minimum temperature of 5-6° C. below ambient temperature and maximum cooling power of 30-47 $W/m^2$. This passive cooling approach, realized using commonly-available low-cost materials, could improve the performance of existing cooling systems as well as lead to new thermal management strategies for applications such as concentrated photovoltaic cooling and refrigeration in regions with limited access to electricity.

Cooling technologies are essential for refrigeration and thermal management applications. Existing cooling processes primarily rely on vapor compression and fluid-cooled systems despite their complexity and high cost. Passive cooling approaches such as atmospheric radiative cooling, relying on the high transparency of earth's atmosphere at mid-infrared wavelengths, can lead to simple and low-cost refrigeration and cooling strategies that can augment existing thermal management solutions. See, for example, Florides, G. A., Tassou, S. A., Kalogirou, S. A. & Wrobel, L. C. Review of solar and low energy cooling technologies for buildings. *Renew. Sustain. Energy Rev.* 6, 557-572 (2002); Kim, D. S. & Ferreira, C. A. I. Solar refrigeration options—a state-of-the-art review. *Int. J. Refrig.* 31, 3-15 (2008); Chan, H. Y., Riffat, S. B. & Zhu, J. Review of passive solar heating and cooling technologies. *Renew. Sustain. Energy Rev.* 14, 781-789 (2010); and Smith, G. & Gentle, A. Radiative cooling: Energy savings from the sky. *Nat. Energy* 2, 17142 (2017), each of which is incorporated by reference in its entirety.

Passive atmospheric radiative cooling approaches take advantage of the spectral overlap of the radiative emission of terrestrial objects near ambient temperature and the transparent "atmospheric window" in the wavelength range from 8 to 13 μm. See, for example, Hossain, M. M. & Gu, M. Radiative Cooling: Principles, Progress, and Potentials. *Adv. Sci.* 3, 1500360 (2016); Sun, X., Sun, Y., Zhou, Z., Alam, M. A. & Bermel, P. Radiative sky cooling: fundamental physics, materials, structures, and applications. *Nanophotonics* 6, 997-1015 (2017); and Zeyghami, M., Goswami, D. Y. & Stefanakos, E. A review of clear sky radiative cooling developments and applications in renewable power systems and passive building cooling. *Sol. Energy Mater. Sol. Cells* 178, 115-128 (2018), each of which is incorporated by reference in its entirety. This radiative access to the cold upper atmosphere through the atmospheric window has been exploited since ancient times to achieve cooling below ambient temperature during the night. However during the day, radiative cooling solutions have to mitigate solar irradiation (~1,000 W/m$^2$) which is an order of magnitude greater than the radiative cooling potential (~100 W/m$^2$) and can impede any cooling. Several recent studies have investigated approaches that rely on spectrally selective surfaces that minimize absorption in the solar spectrum while maximizing emission in the mid-infrared (mid-IR) wavelengths. However, this tightly constrained problem that requires negligible absorption in the solar spectrum and maximum emission in the mid-IR necessitates specialized photonic structures that are expensive and may not be easily accessible. Furthermore, previous work on passive atmospheric radiative cooling has focused on spectral selectivity to enhance cooling performance without regard to the possibility of angular radiative control. While a few studies have investigated the advantages of directional control to radiative cooling and proposed novel angle-selective photonic structures, no experimental demonstrations have been reported. Bartoli, B. et al. Nocturnal and diurnal performances of selective radiators. *Appl. Energy* 3, 267-286 (1977); Addeo, A. et al. Light selective structures for large-scale natural air conditioning. *Sol. Energy* 24, 93-98 (1980); Granqvist, C. G. & Hjortsberg, A. Radiative cooling to low temperatures: General considerations and application to selectively emitting SiO films. *J. Appl. Phys.* 52, 4205-4220 (1981); Berdahl, P., Martin, M. & Sakkal, F. Thermal performance of radiative cooling panels. *Int. J. Heat Mass Transf.* 26, 871-880 (1983); Berdahl, P. Radiative cooling with MgO and/or LiF layers. *Appl. Opt.* 23, 370-372 (1984); Ali, A. H. H. Passive cooling of water at night in uninsulated open tank in hot and areas. *Energy Conyers. Manag.* 48, 93-100 (2007); Nilsson, T. M. J., Niklasson, G. A. & Granqvist, C. G. A solar reflecting material for radiative cooling applications: ZnS pigmented polyethylene. *Sol. Energy Mater. Sol. Cells* 28, 175-193 (1992); Orel, B., Gunde, M. K. & Krainer, A. Radiative cooling efficiency of white pigmented paints. *Sol. Energy* 50, 477-482 (1993); Nilsson, T. M. J. & Niklasson, G. A. Radiative cooling during the day: simulations and experiments on pigmented polyethylene cover foils. *Sol. Energy Mater. Sol. Cells* 37, 93-118 (1995); Gentle, A. R., Aguilar, J. L. C. & Smith, G. B. Optimized cool roofs: Integrating albedo and thermal emittance with R-value. *Sol. Energy Mater. Sol. Cells* 95, 3207-3215 (2011); Raman, A. P., Anoma, M. A., Zhu, L., Rephaeli, E. & Fan, S. Passive radiative cooling below ambient air temperature under direct sunlight. *Nature* 515, 540-544 (2014); Goldstein, E. A., Raman, A. P. & Fan, S. Sub-ambient non-evaporative fluid cooling with the sky. *Nat. Energy* 2, 17143 (2017); Bao, H. et al. Double-layer nanoparticle-based coatings for efficient terrestrial radiative cooling. *Sol. Energy Mater. Sol. Cells* 168, 78-84 (2017); Zhai, Y. et al. Scalable-manufactured randomized glass-polymer hybrid metamaterial for daytime radiative cooling. *Science* 355, 1062-1066 (2017); Rephaeli, E., Raman, A. & Fan, S. Ultrabroadband photonic structures to achieve high-performance daytime radiative cooling. *Nano Lett.* 13, 1457-1461 (2013); Hull, J. R. & Schertz, W. W. Evacuated-tube directional-radiating cooling system. *Sol. Energy* 35, 429-434 (1985); Smith, G. B. Amplified radiative cooling via optimised combinations of aperture geometry and spectral emittance profiles of surfaces and the atmosphere. *Sol. Energy Mater. Sol. Cells* 93, 1696-1701 (2009); and Sakr, E. & Bermel, P. Angle-selective reflective filters for exclusion of background thermal emission. *Phys. Rev. Appl.* 7,044020 (2017), each of which is incorporated by reference in its entirety.

This work describes a directional approach to achieve sub-ambient passive atmospheric cooling during the day. The method takes advantage of the angular confinement of the solar flux in the sky—completely blocking radiative exchange in the narrow direct solar direction while allowing energy transfer in other directions. Theoretical and experimental demonstrations show that significant cooling below ambient temperatures is possible for emitters that are reflective (white) or absorptive (black) in the solar spectrum, despite the large incident solar flux. Energy balance modeling predicts that this approach has the potential to achieve temperatures as low as 20° C. below ambient and cooling powers as high as 83 W/m$^2$. Using a proof-of-concept setup, temperatures as low as 6° C. below ambient and maximum cooling powers of 47 W/m$^2$ for a solar-white emitter and 30 W/m$^2$ for a solar-black emitter around solar noon were measured. The experimental setup fabricated using low-cost readily-available materials—polished aluminum, white polyethylene sheet and commercially available paint—exhibits the simplicity and ease of implementation of the approach.

Directional Approach to Daytime Radiative Cooling

Passive terrestrial daytime radiative cooling relies upon the spectral separation between the high atmospheric transmission at mid-IR wavelengths, coinciding with blackbody emission at ambient temperature, and solar irradiation. FIG. 1A shows the incident solar spectrum and atmospheric transmission in the zenith direction as a function of wavelength. Previous studies primarily relied on spectrally engineered surfaces that maximize radiative emission in the atmospheric window, while reflecting the incident solar radiation. See, for example, Berk, A. et al. MODTRAN radiative transfer code. *Proc. SPIE* 9088, 90880H-1-

90880H-7 (2014); Huang, Z. & Ruan, X. Nanoparticle embedded double-layer coating for daytime radiative cooling. *Int. J. Heat Mass Transf.* 104, 890-896 (2017); Atiganyanun, S. et al. Effective radiative cooling by paint-format microsphere-based photonic random media. *ACS Photonics* 5, 1181-1187 (2018); and Kou, J., Jurado, Z., Chen, Z., Fan, S. & Minnich, A. J. Daytime radiative cooling using near-black infrared emitters. *ACS Photonics* 4, 626-630 (2017), each of which is incorporated by reference in its entirety. However, achieving such spectral selectivity is challenging, particularly due to the large solar flux which needs to be rejected almost perfectly to prevent heating.

Figure 1B:
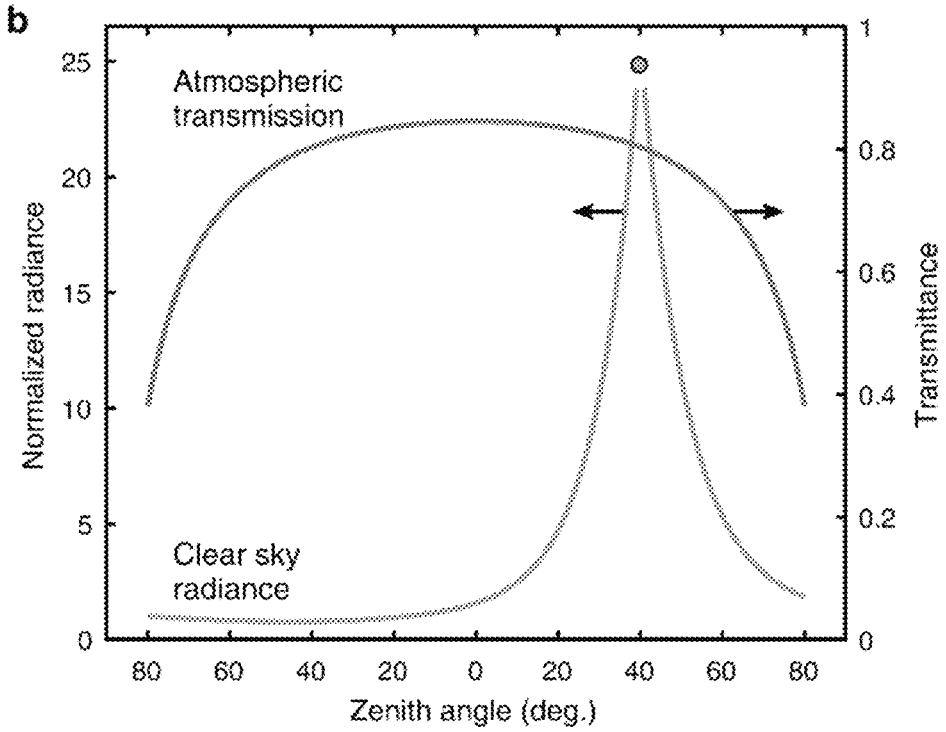
FIG. 1B depicts angular distribution of normalized clear sky radiance in a principal plane that includes the sun (denoted by the circle, shown for a solar zenith angle of 40°) and atmospheric transmittance (shown for 10.5 μm wavelength).

The angular confinement of solar irradiation in the sky enables a complementary approach to passive daytime radiative cooling. FIG. 1B shows the normalized clear sky short wavelength radiance for a solar zenith angle of 40° which illustrates the solar irradiation contribution from different parts of the sky. See, for example, Harrison, A. W. & Coombes, C. A. Angular distribution of clear sky short wavelength radiance. *Sol. Energy* 40, 57-63 (1988); and Coulson, K. L. in *Solar and terrestrial radiation* (Academic Press, 1975), each of which is incorporated by reference in its entirety. The plot also shows the angular atmospheric transmittance at a representative wavelength of 10.5 μm estimated using $\tau_{atm}(\lambda, \theta)=\tau_0(\lambda)^{1/\cos\theta}$,[10] where θ represent the zenith angle and $\tau_0(\lambda)$ represents the atmospheric transmittance in the zenith direction. In comparison with radiance due to the sun, which is concentrated around the solar disk, atmospheric transmittance is nearly constant across all angles other than near the horizon. This angular restriction of the solar irradiation in the sky relative to the broad angular range of high atmospheric transparency in the mid-IR provides an opportunity to selectively emit to the part of sky away from the sun and achieve passive cooling.

Figure 1C:
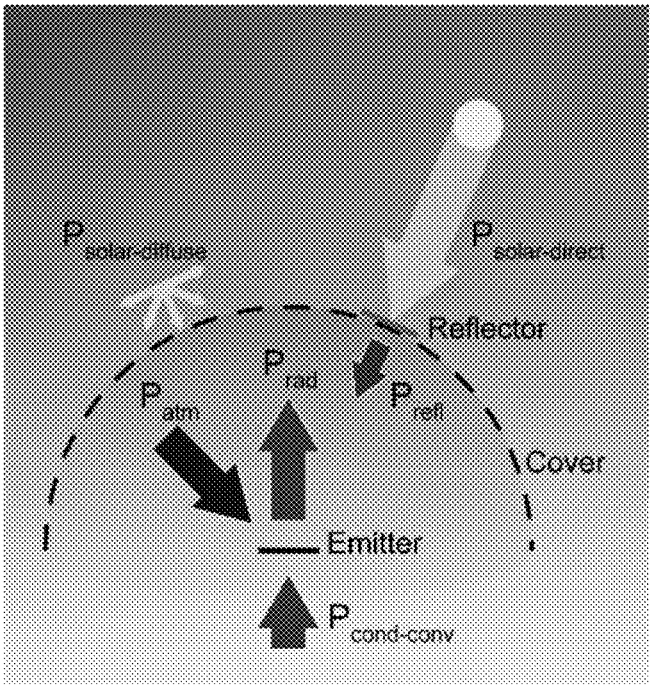
FIG. 1C depicts energy flow diagram showing the possibility of achieving sub-ambient passive cooling during the day by emitting radiation in the mid-infrared wavelength range, while reflecting the angularly-confined direct solar radiation using a broadband reflector and an infrared-transparent cover that reflects diffuse solar radiation.

FIG. 1C schematically shows a device configuration that enables sub-ambient passive radiative cooling using a directional approach. The device concept comprises an emitter in thermal communication with the atmosphere and a reflector that blocks direct solar radiation. The emitter is enclosed within a readily-available cover that is partially transparent in the atmospheric window and partially reflective in the solar spectrum to minimize heat gain due to diffuse solar radiation. The overall cooling power of the emitter (per area), $P_{cooling}$ at a temperature T, can be estimated by accounting for all contributions to the energy balance:

$$P_{cooling}(T)=P_{rad}(T)-P_{atm}(T_{amb})-P_{solar\text{-}direct}-P_{solar\text{-}diffuse}-P_{refl}(T_{refl})-P_{cond\text{-}conv}(T,T_{amb}) \quad (1)$$

The first term in Equation 1, $P_{rad}$, represents the power radiated by the emitter towards the atmosphere. The second term, $P_{atm}$, represents the radiation emitted by the surrounding atmosphere, at an ambient temperature $T_{amb}$, that is absorbed by the emitter. These contributions can be evaluated by integrating the spectral directional radiance leaving or absorbed by the emitter over all wavelengths and solid angles (Ω) over the atmospheric hemisphere excluding the solid angle subtended by the reflector ($\Omega_{refl}$), as shown in Equations 2 and 3.

$$P_{rad}(T)=\int_{\Omega-\Omega_{refl}} d\Omega\cos\theta\int_0^\infty d\lambda I_{BB}(T,\lambda)\tau_{cover}(\lambda,\theta)\varepsilon(\lambda,\theta) \quad (2)$$

-continued $$P_{atm}(T_{amb})=\int_{\Omega-\Omega_{refl}} d\Omega\cos\theta\int_0^\infty d\lambda I_{BB}(T_{amb},\lambda)\varepsilon_{atm}(\lambda,\theta)\tau_{cover}(\lambda,\theta)\varepsilon(\lambda,\theta) \quad (3)$$

Here, $I_{BB}$ represents the spectral radiance of a blackbody, ε(λ, θ) represents the spectral directional emittance of the emitter, $\varepsilon_{atm}(\lambda,\theta)=1-\tau_{atm}(\lambda,\theta)$ represents the spectral directional emittance of the atmosphere and $\tau_{cover}(\lambda,\theta)$ (represents the spectral directional transmittance of the cover.

The incident solar irradiation comprises of direct beam and circumsolar radiation emanating from the solar disk, equivalent to a solid angle of $6.87\times10^{-5}$ steradians (about 0.5° in 2D), and isotropic diffuse solar radiation.[32] For the device configuration (FIG. 1C), the direct solar irradiation, including the direct beam and circumsolar components, is rejected by the reflector and never reaches the emitter, that is $P_{solar\text{-}direct}=0$ The contribution from the diffuse solar radiation, $P_{solar\text{-}diffuse}$, transmitting through the cover and absorbed by the emitter is determined by estimating the isotropic diffuse solar spectral radiance, $I_{solar\text{-}diffuse}(\lambda)$, as shown in Equation 4. (Details of $I_{solar\text{-}diffuse}(\lambda)$ estimation are shown in Section 1 below).

$$P_{solar\text{-}diffuse}=\int_{\Omega-\Omega_{refl}} d\Omega\cos\theta\int_0^\infty d\lambda I_{solar\text{-}diffuse}(\lambda)\tau_{cover}(\lambda,\theta)\varepsilon(\lambda,\theta) \quad (4)$$

The direct-solar reflector also emits radiation towards the emitter reducing its cooling power. The radiative contribution from the reflector towards the emitter cooling power $P_{refl}$, represented by Equation 5, is dependent on the reflector emittance $\varepsilon_{refl}(\lambda,\theta)$ and temperature $T_{refl}$ (estimated using an energy balance on the reflector under direct solar radiation). Thus the effect of the reflector can be minimal for a highly reflective surface or if the solid angle subtended by the reflector at the emitter is small.

$$P_{refl}=\int_{\Omega_{refl}} d\Omega\cos\theta\int_0^\infty d\lambda I_{BB}(T_{refl},\lambda)\varepsilon_{refl}(\lambda,\theta)\tau_{cover}(\lambda,\theta_{sun})\varepsilon(\lambda,\theta) \quad (5)$$

In addition to the radiative contributions, conduction and convection from any support structure and surrounding air also reduces emitter cooling. These non-radiative parasitic losses $P_{cond\text{-}conv}$ can be lumped together and quantified using an effective conductive-convective heat transfer coefficient $h_{cond\text{-}conv}$ as shown in Equation 6.

$$P_{cond\text{-}conv}=h_{cond\text{-}conv}(T_{amb}-T) \quad (6)$$

Figure 1D:
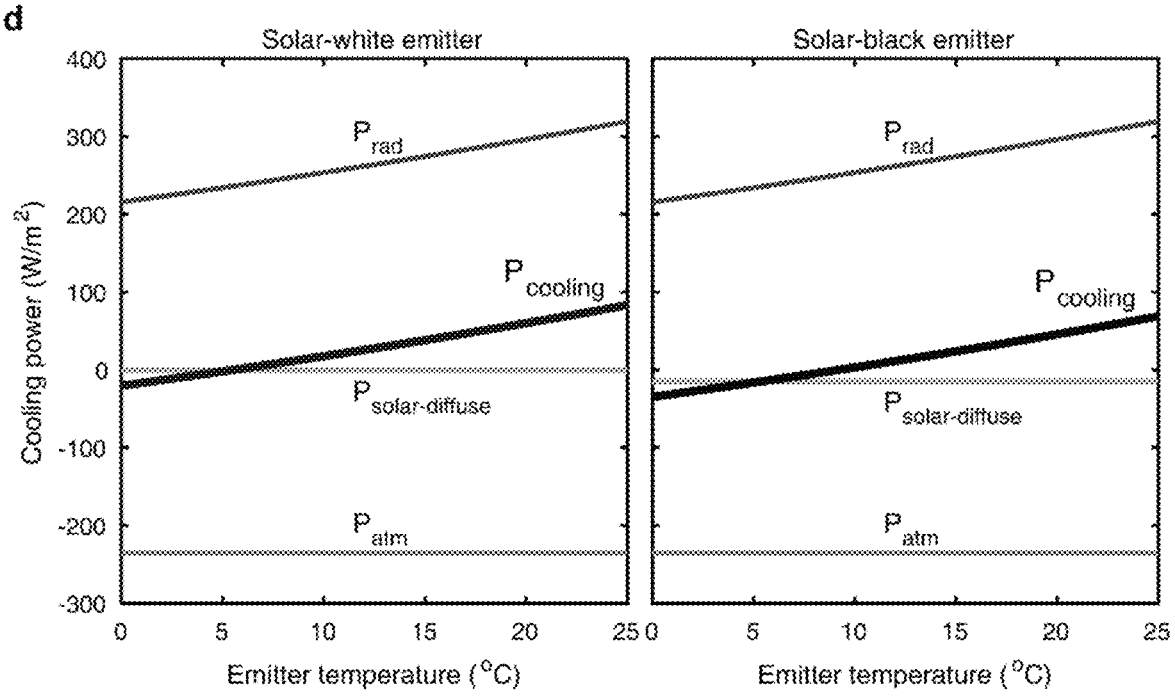
FIG. 1D depicts estimated net radiative cooling power $P_{cooling}$ as a function of emitter temperature (ambient temperature: 25° C.) and constituent contributions for an ideal solar-white emitter ($\lambda<2.5$ μm: $\varepsilon=0$, $\lambda\geq2.5$ μm: $E=1$, $\forall\theta$) and ideal solar-black emitter ($\varepsilon=1$, $\forall\lambda$, $\theta$) coupled with a perfect direct-solar reflector ($\rho_{refl}=1$, $\forall\lambda$, $\theta$) and a representative diffuse-solar cover ($\lambda<2.5$ μm: $\rho_{cover}=0.8$, $\lambda\geq2.5$ μm: $\tau_{cover}=1-\rho_{cover}=0.9$, $\forall\theta$).

The potential cooling performance of the proposed approach is predicted using an idealized model based on the radiative contributions described above. FIG. 1D shows the net cooling power and different radiative contributions for solar-white (λ<2.5 μm: ε=0) and solar-black (λ<2.5 μm: ε=1) emitters with perfect emission in the infrared (λ≥2.5 μm: ε=1) coupled with ideal direct solar reflectors. The model assumes an easily available diffuse solar cover with a typical solar reflectance of 0.8 and infrared transmittance of 0.9, and no parasitic heat gain (i.e., $h_{cond\text{-}conv}=0$). See, for example, Hsu, P.-C. et al. Radiative human body cooling by nanoporous polyethylene textile. *Science* 353, 1019-1023 (2016), which is incorporated by reference in its entirety. At the 25° C. ambient temperature, $P_{rad}$=319 W/m$^2$ and $P_{atm}$=235.5 W/m$^2$ for both the solar-white and solar-black emitters, giving a total cooling potential of 83.5 W/m$^2$. The solar contribution depends on the magnitude of diffuse solar radiation and emitter absorptance in the solar spectrum. Thus, for the presented case where the total $I_{solar\text{-}diffuse}$=76 W/m$^2$, $P_{solar\text{-}diffuse}$=0.5 W/m$^2$ for the solar-white emitter, $P_{solar\text{-}diffuse}$=15 W/m$^2$ for the solar-black emitter. Overall, the model shows that a solar-white emitter can have a maximum cooling power of 83 W/m$^2$ and minimum temperature of 20° C. below ambient, while a solar-black emitter shows a maximum cooling power of 69 W/m$^2$ and minimum temperature of 16° C. below ambient. Even higher cooling powers and lower sub-ambient temperatures are possible using a diffuse solar cover with a higher solar reflectance and infrared transmittance. Thus it is shown that sub-ambient cooling is possible for a range of emitter properties using the directional radiative cooling approach.

Experimental Design

We designed a proof-of-concept demonstration that obstructed direct solar irradiation, diminished diffuse solar irradiation, maximized emission in the atmospheric window, reduced infrared absorption and minimized heat gain due to conduction and convection. The device (FIG. 2A) comprised of a thin, thermally-conductive copper emitter (50 mm diameter) with its emitting surface coated using a commercially available white/black spray paint and back surface attached with a thermocouple. (Details of device design and fabrication are included in the Section 2 below). The emitter rested on thermal insulation (50 mm diameter) to minimize heat transfer due to conduction. Two layers of nanoporous polyethylene, separated by a 6.4 mm air gap, covered the emitter (while being physically separated) and minimized transmission of diffuse solar radiation and served as a convection barrier. All lateral surfaces of the emitter-cover assembly were covered with aluminized Mylar and housed inside a polished aluminum cylinder and aperture (50 mm diameter) to minimize parasitic radiative heat transfer. A polished aluminum reflector (60 mm diameter), mounted on a custom-fabricated track, was suspended ~10 cm above the emitter plane to provide the emitter sufficient atmospheric access while keeping the device relatively compact. The path of the sun in the sky and its position at a given time determined the shape of the track and the reflector location relative to the emitter. The orientation of the device was determined based on the solar trajectory and the reflector was moved along the track manually during the course of the experiment.

Figure 2A:
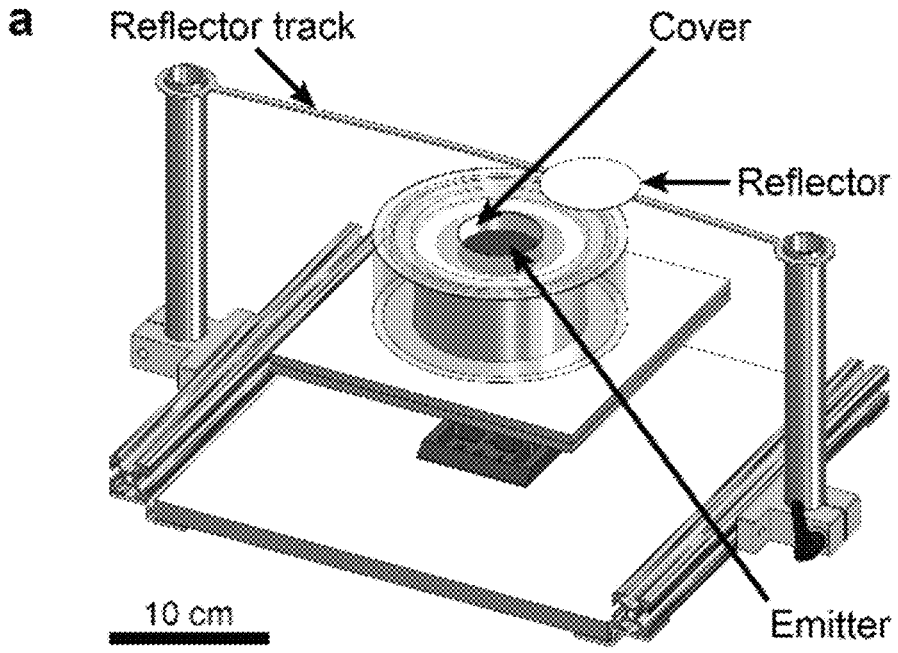
FIG. 2A depicts a proof-of-concept demonstration as a CAD drawing and photograph (FIG. 2B) of the fabricated device comprising of a white/black painted copper emitter that emits radiation in the mid-IR, a two-layer nanoporous polyethylene convection cover that partially reflects diffuse solar irradiation, and a polished aluminum reflector capable of moving along a track that is adjusted based on the sun position and reflects direct solar irradiation.
Figure 2B:
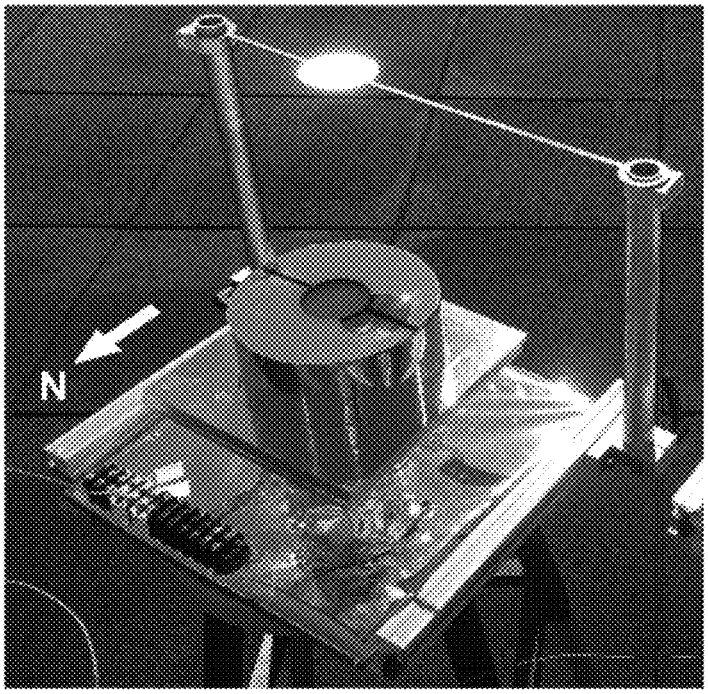
FIG. 2C depicts spectral direct-hemispherical reflectance of the reflector (top), two-layer cover (middle) and white- and black-painted emitters (bottom).
Figure 2C:
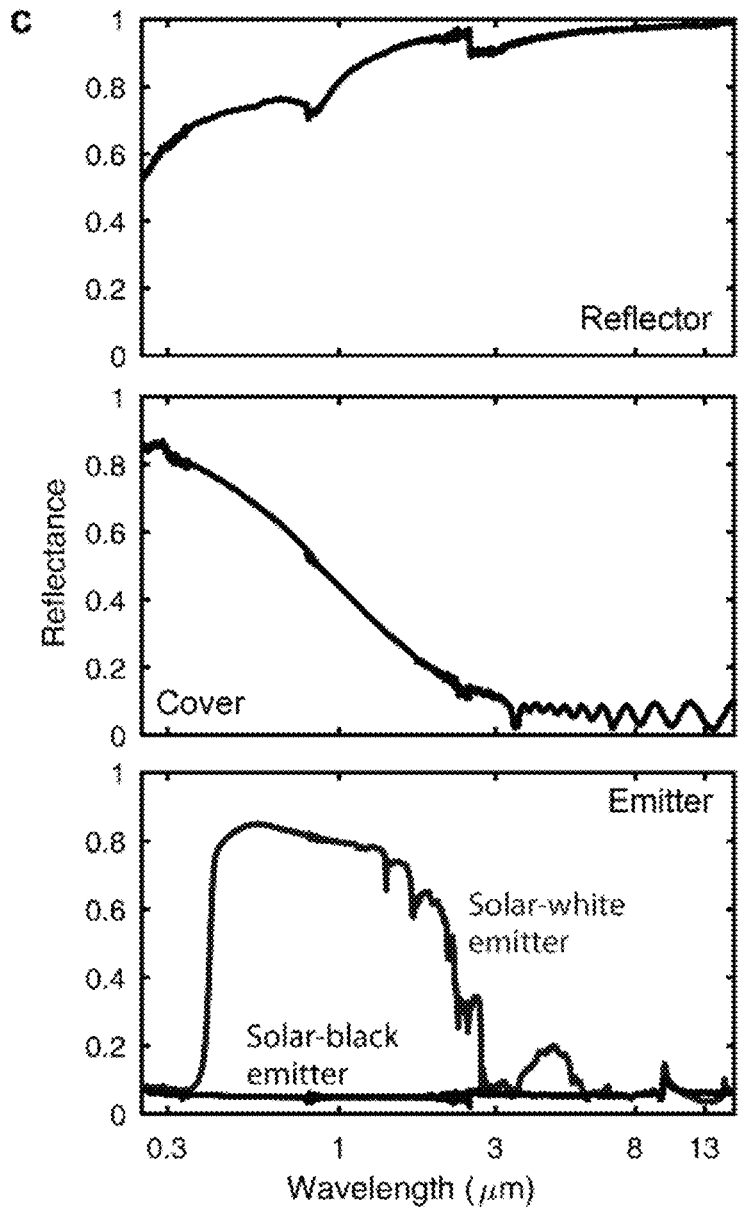

The design of the experimental setup and spectral properties of the reflector and cover allowed decoupling the solar irradiation and mid-IR emission from the emitter, enabling passive daytime cooling. FIG. 2C shows the spectral reflectance of the reflector, cover and emitter(s) in the solar as well as the infrared spectra. The polished aluminum reflector has broadband high reflectance and thus reflects most of the large direct solar irradiation. While there is some absorption in the aluminum mirror due to its imperfect reflectance in the solar spectrum, cooling due to convection limits the temperature rise of the reflector. In addition, the small view factor between the reflector and emitter ensures minimal loss in emitter cooling power due to radiative transfer with the reflector. The double-layer nanoporous polyethylene convection cover, with a solar-weighted reflectance of 55% and an average transmittance of 92% in the atmospheric window, reflects a majority of the diffuse solar irradiation while allowing transmission of almost all the radiation leaving the emitter. The paint-coated emitter has high emittance in mid-IR which maximized the emission in the atmospheric window. Two paints were chosen—one that was reflecting (white) and another that was absorbing (black) in the solar spectrum—to investigate the range of cooling performance as a function of emitter properties.

Experimental Results

Figure 3:
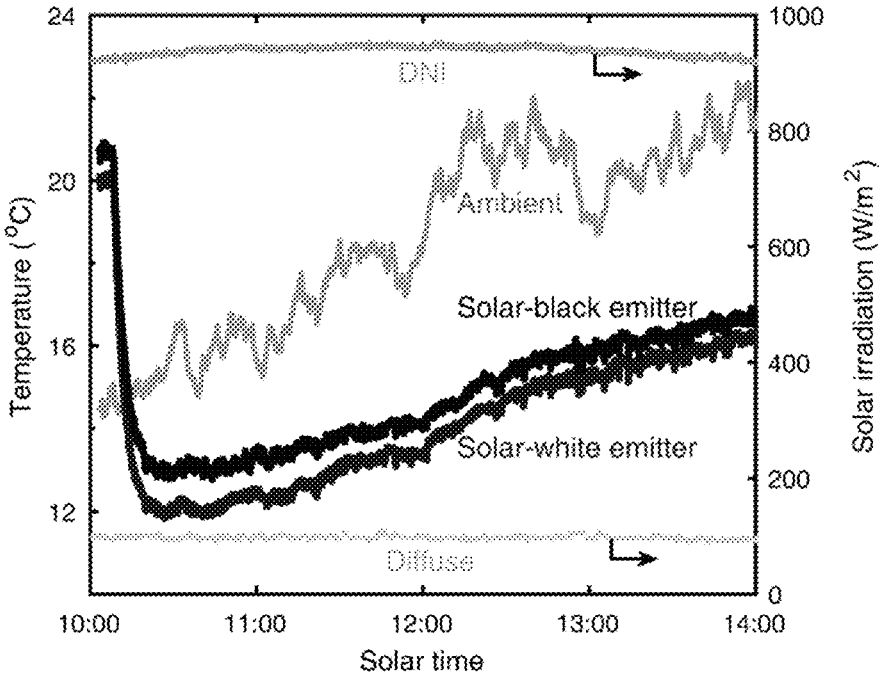
FIG. 3 depicts stagnation temperature measurement around solar noon. Temperature of solar-white and solar-black emitters measured simultaneously two hours before and two hours after solar noon. Measured ambient temperature and direct normal irradiance (DNI) and diffuse solar irradiation are also shown for reference. The nanoporous polyethylene cover shielded the emitters from diffuse solar irradiation and the polished reflector was periodically moved along the track to prevent exposure from direct solar irradiation. The devices were initially covered with aluminum covers which were removed 5 minutes after starting data acquisition. Access to the atmosphere and reflection of solar irradiation caused the temperature of both devices to decrease drastically at first and then hold relatively steady ~5° C. below ambient temperature. The rooftop measurement was done on a clear day in Cambridge, MA (October).

Outdoor measurements were performed simultaneously on two devices placed next to each other, each comprising a polished aluminum direct solar reflector, nanoporous polyethylene convection cover and painted copper emitter as described in the previous section. One device included an emitter coated with a solar-white paint while the emitter of the other device was coated with solar-black paint. (Details of the measurement setup are provided in Section 3 below). To measure the lowest achievable temperature using our devices, we measured the stagnation temperature of the emitters on a clear day around solar noon (FIG. 3). (Refer to Section 6 below for the measured weather parameters for all experiments). Initially, the device apertures were covered to block atmospheric access as well as solar irradiation. Soon after the aperture covers were removed, the temperature of both the solar-white and solar-black devices dropped sharply and reached below the ambient temperature. At solar noon, the solar-white emitter reached a temperature of 6° C. below ambient and the solar-black emitter was 5.5° C. below ambient. While the solar-white emitter was always cooler than the solar-black, the difference in their temperatures was <1° C., indicating that the contribution from solar absorption is small—likely from diffuse solar irradiation. In addition, the emitter temperatures followed the ambient temperature trend closely and the temperature difference between the emitters and ambient increased after solar noon. These results can be attributed to parasitic heat gain due to conduction and convection, and solar absorption and heating of the exposed surfaces of the horizontally-oriented device which decreased as the sun moves lower in the horizon beyond solar noon. Overall the significant reduction of the device stagnation temperature, ~5° C. below the ambient temperature during the course of the measurement, demonstrates the possibility of achieving passive cooling using the demonstrated directional approach.

Figure 4A:
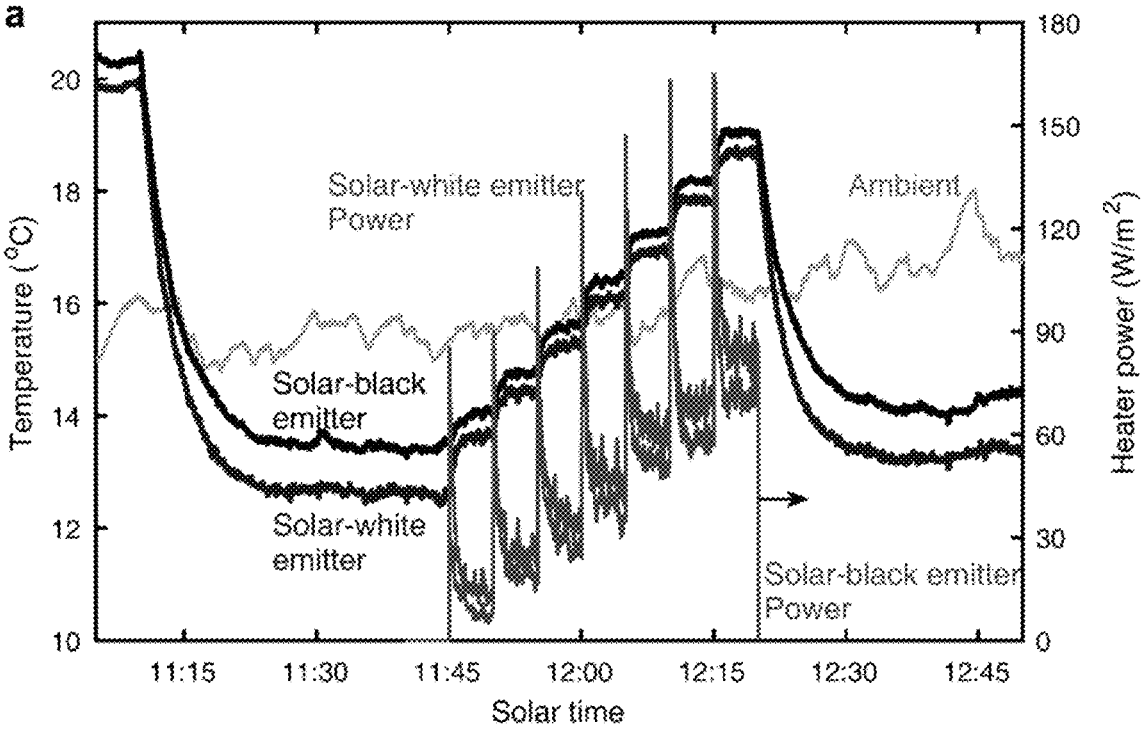
FIG. 4A depicts cooling power measurement around solar noon. Cooling power was measured using thin electrically-insulating heaters attached to the back of the emitters. The heaters were off initially as the devices reached thermal equilibrium below ambient temperature, similar to the stagnation temperature measurement. Once the emitter temperature stabilized, the emitter temperature was raised beyond the ambient temperature in a step-wise manner by increasing the heater power (red and brown curves plotted on the right y-axis, divided by the emitter area) regulated using PID control in 5 minute increments. Finally, the heaters were turned off and the emitters allowed to reach stagnation temperature.

Outdoor measurements were also performed to directly measure the cooling power as a function of emitter temperature. The cooling power measurement utilized an experimental setup and procedure similar to that for the stagnation temperature. Thin-film heaters were attached to the backside of both emitters, in addition to thermocouples, to quantify the cooling power at different emitter temperatures. The measurement was performed around solar noon on a mostly clear day (FIG. 4A). First, the emitters were allowed to passively cool below the ambient temperature as in the stagnation temperature measurement. Next, the PID-controlled heaters were turned on—the heater power was increased incrementally to raise the emitter temperature in approximately uniform steps until the emitter temperatures rose above the ambient temperature. Finally, the heaters were turned off and the emitters were allowed to passively cool to their steady temperature below ambient. The input heater power, measured after the stabilization of emitter temperatures, for each step represents the passive cooling power of the system.

Figure 4B:
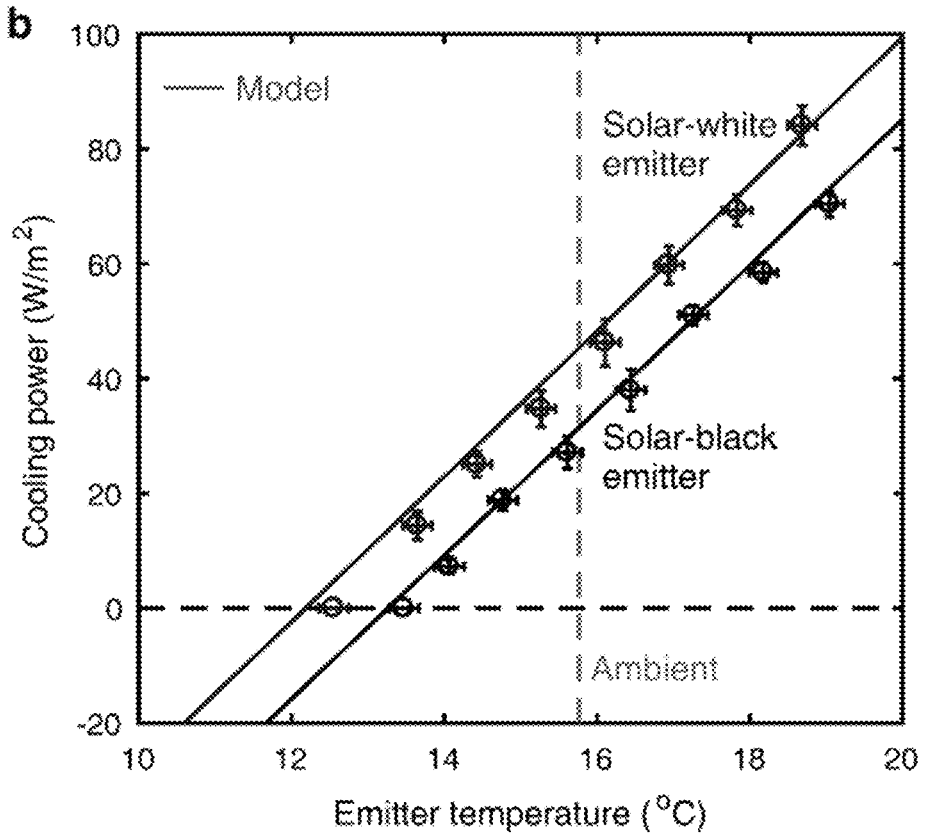
FIG. 4B depicts cooling power measured for the solar-white and solar-black emitters as a function of emitter temperature. Each symbol corresponds to the heater power and emitter temperature at each step (shown in FIG. 4A), averaged over the last 3 minutes. Corresponding modeled performance calculated using measured properties and conditions is also shown. The constant ambient temperature value shown for reference represents the average ambient temperature measured during the power measurement. The measurement was done on a mostly clear day in Cambridge, MA (October).

FIG. 4B shows the time series data obtained (FIG. 4A) as cooling power as a function of emitter temperature for the solar-white and solar-black emitters. The maximum cooling power, corresponding to the measured power when the emitter and ambient temperatures are equal, was 47 $W/m^2$ for the solar-white emitter and 30 $W/m^2$ for the solar-black emitter. As expected, these values are lower than the cooling powers predicted by the idealized model shown in FIG. 1D which assumed perfect emitter and reflector properties. The measured stagnation temperature, corresponding to zero cooling power, of the solar-white emitter was lower than the solar-black emitter by about 1° C., as in the stagnation temperature measurement (FIG. 3). However, the maximum cooling below ambient temperature was lower than in FIG. 3, due to different atmospheric conditions and greater conductive thermal loss through the heater wires. FIG. 4B also plots the corresponding modeled device cooling performance. The model described earlier was modified to account for the measured spectral properties of the emitters, cover and reflector, device geometry, ambient temperature during the measurement, as well as the conductive-convective losses in the system. The conductive-convective loss was quantified using an effective heat transfer coefficient of 9.6 $W/m^2K$, estimated using a COMSOL model (Section 4 below). The relatively high conductive-convective heat transfer coefficient indicates that better performance is possible—lower minimum temperatures and higher cooling powers at intermediate temperatures—through scale-up and improved thermal insulation. Maximum cooling power can also be increased by improving the radiative properties of the emitter, cover and reflector, and minimizing parasitic solar absorption by all surfaces.

Discussion

This experimental demonstration of a novel directional approach to passive daytime radiative cooling provides a simple, low-cost method of achieving sub-ambient cooling. This approach takes advantage of the angularly confined nature of the dominant direct solar irradiation to decouple it from the diffuse component which is an order of magnitude lower in intensity. Unlike previous spectrally-selective approaches that need to rely on near-perfect solar reflection to achieve sub-ambient cooling, this work demonstrates that it is possible to reach below ambient temperatures even with commonly available materials. In addition, by decoupling emission in the atmospheric window (by the emitter) and solar reflection (by the direct solar reflector and diffuse solar reflecting cover), we relax the optimization constraints that can lead to significantly improved cooling performance.

This proof-of-concept demonstration is a significant first step that validates the concept of directional passive daytime radiative cooling and opens possibilities for improved device design and performance. One inherent constraint with the directional approach is the need for sun position tracking. While the need for solar tracking prohibits infinite scaling of this concept, it is not necessarily limiting. Section 5 (below) shows an experimental measurement of stagnation temperature using a band-type polished aluminum direct solar reflector that ensured the emitter was under shade and required no adjustment throughout the day. In addition, a white polyethylene cover made from a grocery bag was used which had a solar-weighted reflectance of only 39% and transmittance of 67% in the atmospheric window. A stagnation temperature of approximately 4° C. below ambient temperature was measured—comparable to the performance reported in the FIG. 3 for a disk-type reflector, despite the larger solid-angle subtended by the band-reflector and sub-optimal radiative properties of the cover. Thus, a cooling device with an adjustable shadow ring-type direct-solar reflector is envisioned, often used for diffuse sky radiation measurements, made using readily-available low-cost materials. See, for example, Robinson, N. An occulting device for shading the pyrheliometer from the direct radiation of the sun. *Bull. Am. Meteorol. Soc.* 36, 32-34 (1955); and De Oliveira, A. P., Machado, A. J. & Escobedo, J. F. A new shadow-ring device for measuring diffuse solar radiation at the surface. *J. Atmos. Ocean. Technol.* 19, 698-708 (2002), each of which is incorporated by reference in its entirety.

This work could improve the performance of existing passive cooling solutions as well as lead to novel refrigeration and air-conditioning approaches. By eliminating the stringent requirement to reflect direct solar irradiation, even higher cooling power and lower temperatures can be achieved by combining the directional approach with existing spectrally selective approach to daytime radiative cooling. In addition, this demonstration also proves the viability of future angular-selective photonic devices for passive daytime radiative cooling. See, for example, Shen, Y. C. et al. Optical broadband angular selectivity. *Science* 343, 1499-1501 (2014); Shen, Y. et al. Metamaterial broadband angular selectivity. *Phys. Rev. B* 90, 125422 (2014); and Shen, Y., Hsu, C. W., Yeng, Y. X., Joannopoulos, J. D. & Soljačić, M. Broadband angular selectivity of light at the nanoscale: Progress, applications, and outlook. *Appl. Phys. Rev.* 3, (2016), each of which is incorporated by reference in its entirety. Furthermore, this directional radiative cooling can be readily implemented in thermal management solutions for concentrated photovoltaic systems, which already include solar-tracking systems. See, for example, Zhu, L., Raman, A., Wang, K. X., Anoma, M. A. & Fan, S. Radiative cooling of solar cells. *Optica* 1, 32-38 (2014); and Li, W., Shi, Y., Chen, K., Zhu, L. & Fan, S. A comprehensive photonic approach for solar cell cooling. *ACS Photonics* 4, 774-782 (2017), each of which is incorporated by reference in its entirety. Finally, a low-cost passive radiative cooler could enable refrigeration system for medicine supplies and food in rural areas with limited access to electricity.

Methods

Temperature measurement: Emitter temperature was measured using K-type thermocouples (Omega 5TC-TT-K-36-36) attached on the back of the thin copper disk (near the center) using thermally conducting silver paste. All thermocouples were calibrated prior to application using a precise immersion style RTD sensor (Omega P-M-A-1/4-3-1/2-PS-12) and a chiller (Thermo Scientific A25). The RTD sensor and thermocouples were inserted into holes drilled in an isothermal copper block which was immersed in the chiller water bath. The RTD temperature was read using a multimeter (Keithley 2000) and the thermocouples were read using a DAQ module (Measurement Computing USB-TC) with on-board cold junction compensation sensors enclosed in an aluminum box—similar to the configuration used for outdoor measurements. The calibration result for each thermocouple was used to correct the offset error and the slope error was propagated to calculate the measurement uncertainty (≈±0.2° C.).

Cooling power measurement: Cooling power was determined by measuring the electrical power input into Kapton® insulated flexible heaters (Omega KHR-2/2-P) attached to the back of the copper emitters. Each heater was connected to a sourcemeter (Keithley 2425) using a four-wire configuration and the input power was regulated by PID control implemented using LabVIEW. The sourcemeter accuracy and fluctuation in measured heater power (during the averaging period, after the initial sharp change in power) were used to calculate the cooling power uncertainty plotted in FIG. 4B. Previous studies have reported cooling power measured using PID control when the emitter temperature is equal to ambient temperature, or at different emitter temperatures by varying the fixed heater power and allowing the emitter temperature to respond based on thermal time constant of the device. The cooling power at different emitter temperatures was measured using PID control which allowed us to span the range of cooling powers at different operating conditions and perform measurements in a short time span (5 minutes per emitter temperature) when the weather conditions stayed relatively uniform.

Solar-reflector tracking: The sun position (zenith and azimuth angle) was computed relative to the experimental setup at the time and date of the experiment using an adapted version[41,42] of the solar position algorithm presented by Meeus. See, for example, Meeus, J. H. *Astronomical Algorithms*. (Willmann-Bell, Incorporated, 1991), which is incorporated by reference in its entirety. The solar-reflector track path was then calculated from the computed sun position and from a fixed vertical distance from the emitter such as to block the line of sight between the emitter and the sun during the whole time of the experiment. A reasonable vertical distance was chosen that would ensure a sufficiently small view factor between the emitter and the solar-reflector (Section 2 below). The solar-reflector track path was imported in a computer-aided design (CAD) software to design the solar-reflector track. Finally, the track was cut from a 1.5 mm thick aluminum sheet by water jet.

Optical property measurement: The direct-hemispherical reflectance of the reflector, polyethylene cover and absorbers using a UV-Vis-NIR spectrophotometer (Cary 5000, Agilent) was measured with an integrating sphere (Internal DRA-2500, Agilent) and an FTIR spectrometer (Nicolet 6700, Thermo Scientific) with an integrating sphere (Mid-IR IntegratIR™, Pike Technologies).

Solar DNI and diffuse measurement: The direct normal irradiance (DNI) and the global tilted irradiance (GTI) were measured by a pyrheliometer (EKO MS-56, ISO First Class) and a pyranometer (EKO MS-402, ISO First Class), respectively. Both sensors were mounted on a 2-axis tracker (EKO STR-32G) and aligned to point to the sun during tracking. The pointing accuracy of the tracker was <0.01°. The diffuse solar irradiance was calculated as the difference between GTI and DNI.

Section 1: Diffuse Radiation Modeling

The total solar radiation incident on a surface can be classified into its diffuse and direct beam components. The direct beam component from the solar disk was completely reflected in the experiment. The diffuse component accounts for the solar radiation contribution from the sky outside the solar disk. The diffuse fraction ($I_d$) of the total solar radiation (I) was estimated using the Erbs et al. correlation (see, Duffie, J. A. & Beckman, W. A. in Solar Engineering of Thermal Processes (John Wiley & Sons, Inc., 2013), which is incorporated by reference in its entirety):

$$\frac{I_d}{I} = \begin{cases} 1.0 - 0.09k_T & \text{for } k_T \le 0.22 \\ 0.9511 - 0.1604k_T + 4.388k_T^2 - 16.638k_T^3 + 12.336k_T^4 & \text{for } 0.22 < k_T \le 0.80 \\ 0.165 & \text{for } k_T > 0.8 \end{cases} \quad \text{(S1)}$$

where $$k_T = \frac{I}{I_o}$$

is the clearness defined using the total global radiation, I, calculated from the AM1.5 solar spectrum and the total extraterrestrial radiation, $I_o$, calculated from the AM0 solar spectrum. The direct beam radiation, $I_b$, is thus simply equal to $I-I_d$. The diffuse contribution can be further classified into (1) the isotropic contribution received uniformly across the entire sky dome, (2) the circumsolar contribution from the region around the solar disk, (3) the horizon brightening contribution concentrated near the horizon. For this experiment, comprising of a horizontal surface without optical access to the horizon and the region around the sun blocked by a reflector, it is possible to neglect the circumsolar contribution and horizon brightening and treat the diffuse solar radiation as uniform across the sky. The isotropic diffuse radiation, $I_{d,iso}$, for a horizontal surface is estimated using the HDKR model[1]:

$$I_{d,iso} = I_d(1 - A_i), \text{ where } A_i = \frac{I_b}{I_o}. \quad \text{(S2)}$$

Equations S1 and S2 were used to calculate the isotropic diffuse spectral irradiance $I_{d,iso}(\lambda)$ (units: W/m$^2$ μm) assuming the same spectral distribution for the diffuse and direct beam components[1] The diffuse solar spectral radiance (units: W/m$^2$ μm sr), $I_{solar\text{-}diffuse}(\lambda)$, used in Equation 4 of the main text, was calculated by dividing $I_{d,iso}(\lambda)$ by the solid angle of the integration domain.

Section 2: Device Design and Fabrication

Figure 5A:
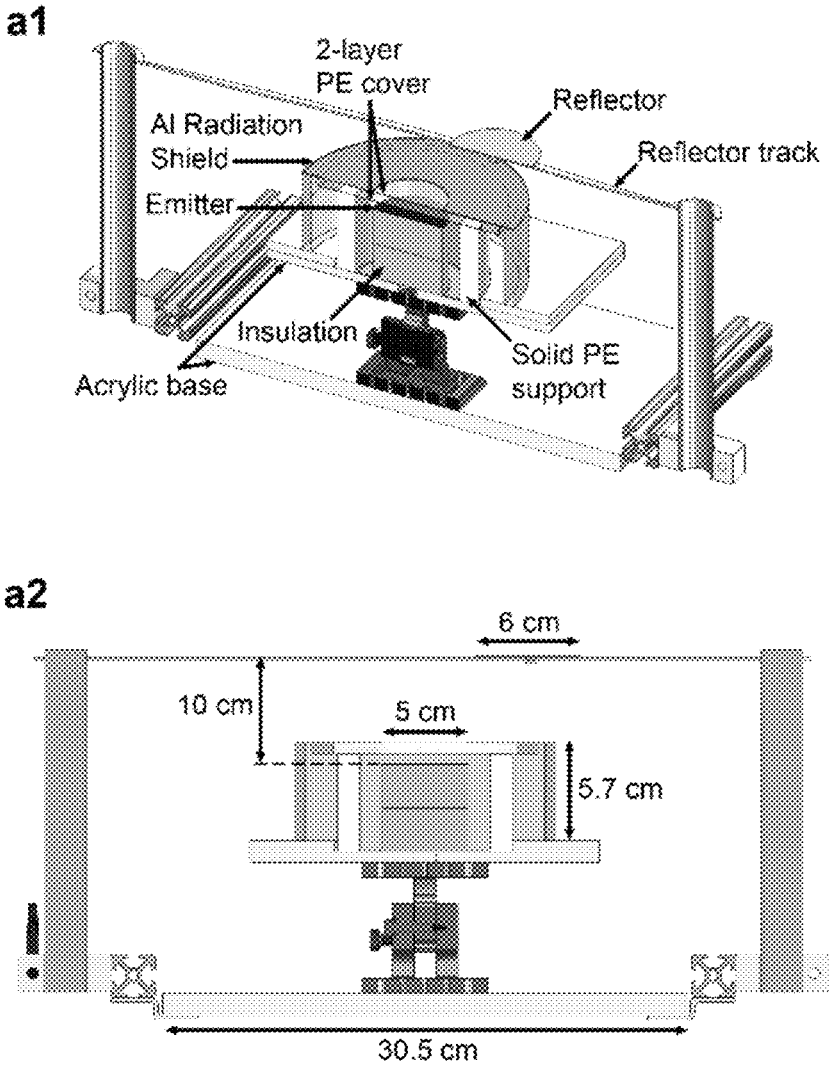
FIGS. 5A-5B depict device construction. Device cross-section trimetric (a1) and front view (a2). Images showing different device components: solar-white (b1) and solar-black (b2) emitters placed over thermal insulation, solid polyethylene (PE) support (b3), 2-layer polyethylene cover (b4), polished aluminum radiation shield and aperture (b5), and direct-solar reflector (b6).
Figure 5B:
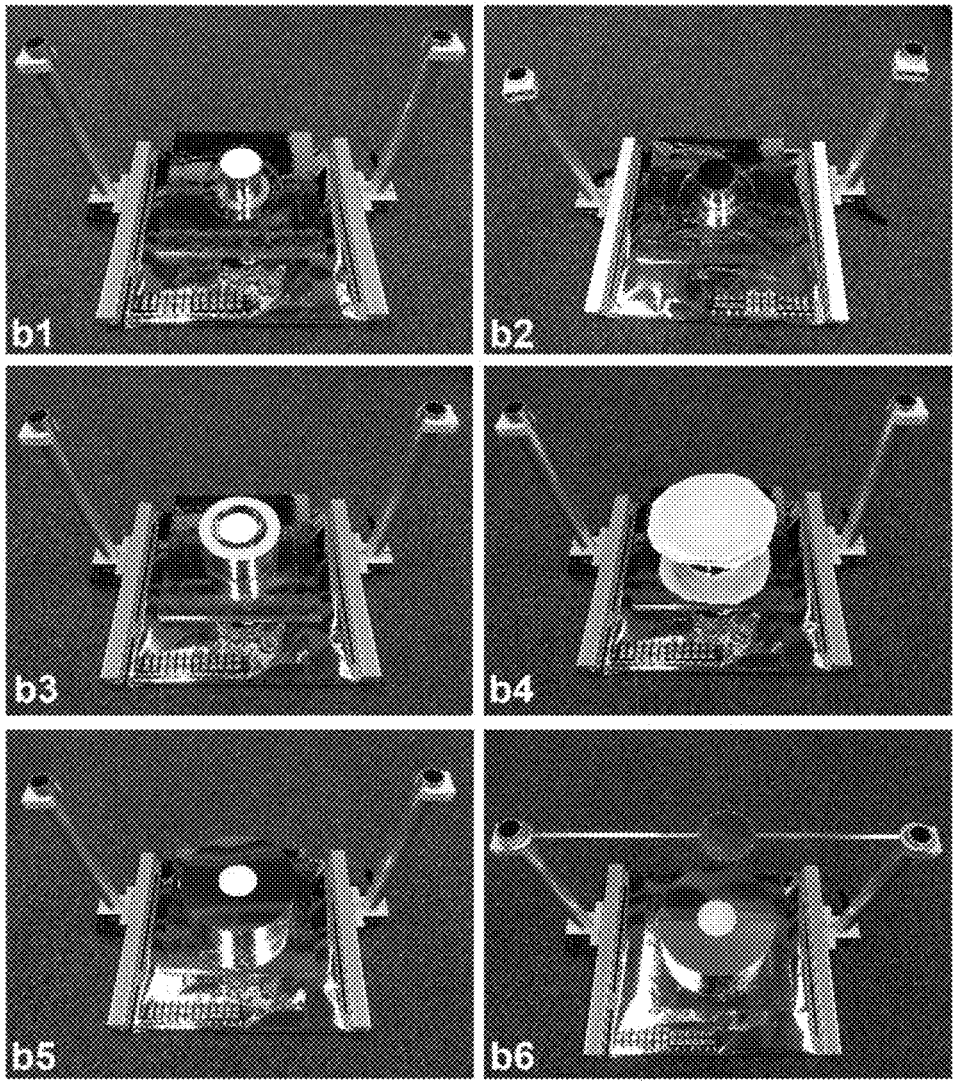

FIGS. 5A-5B show cross-section CAD drawings and photographs of the fabricated device assembly. The device consisted of a disk-shaped copper emitter, 5 cm in diameter and 0.5 mm thick. The top side of the emitter was painted using three coats of flat white or flat black spray paint (Krylon Colormaster®) that was relatively black in the mid-infrared wavelengths. The emitter rested on two layers of 2.5 cm thick extruded polystyrene thermal insulation (FOAMULAR® 150) cut to match the diameter of the emitter. The insulation was surrounded by a solid polyethylene (PE) tube (inner diameter: 7.6 cm, outer diameter: 10.2 cm), which served as support for the convection cover. The diffuse-solar reflecting and convection cover was made using two 16 μm thick sheets of nanoporous polyethylene (Targray Technology International Inc., PE Separator Wet-Stretch) attached to a 6.4 mm thick aluminum ring (inner diameter: 10.7 cm, outer diameter 12.7 cm). This assembly was covered with a 5.7 cm tall polished aluminum hollow cylinder (inner diameter: 14 cm, outer diameter: 15.2 cm) with a polished aluminum sheet on top containing a 5 cm diameter aperture for the emitter. The device assembly was mounted on an acrylic base. The curved surfaces of the thermal insulation and solid PE support, as well as the acrylic base were covered with aluminized Mylar to minimize radiative transfer and solar absorption. The reflector assembly was mounted to the acrylic base using 80/20 frame that allowed the hollow rods supporting the reflector track to move relative to the emitter. The reflector comprised of a 6 cm diameter polished aluminum disk capable of moving along a custom-fabricated (using water jet) aluminum track. The height of the reflector was fixed at ~10 cm above the emitter.

Section 3: Measurement Setup

Figure 6:
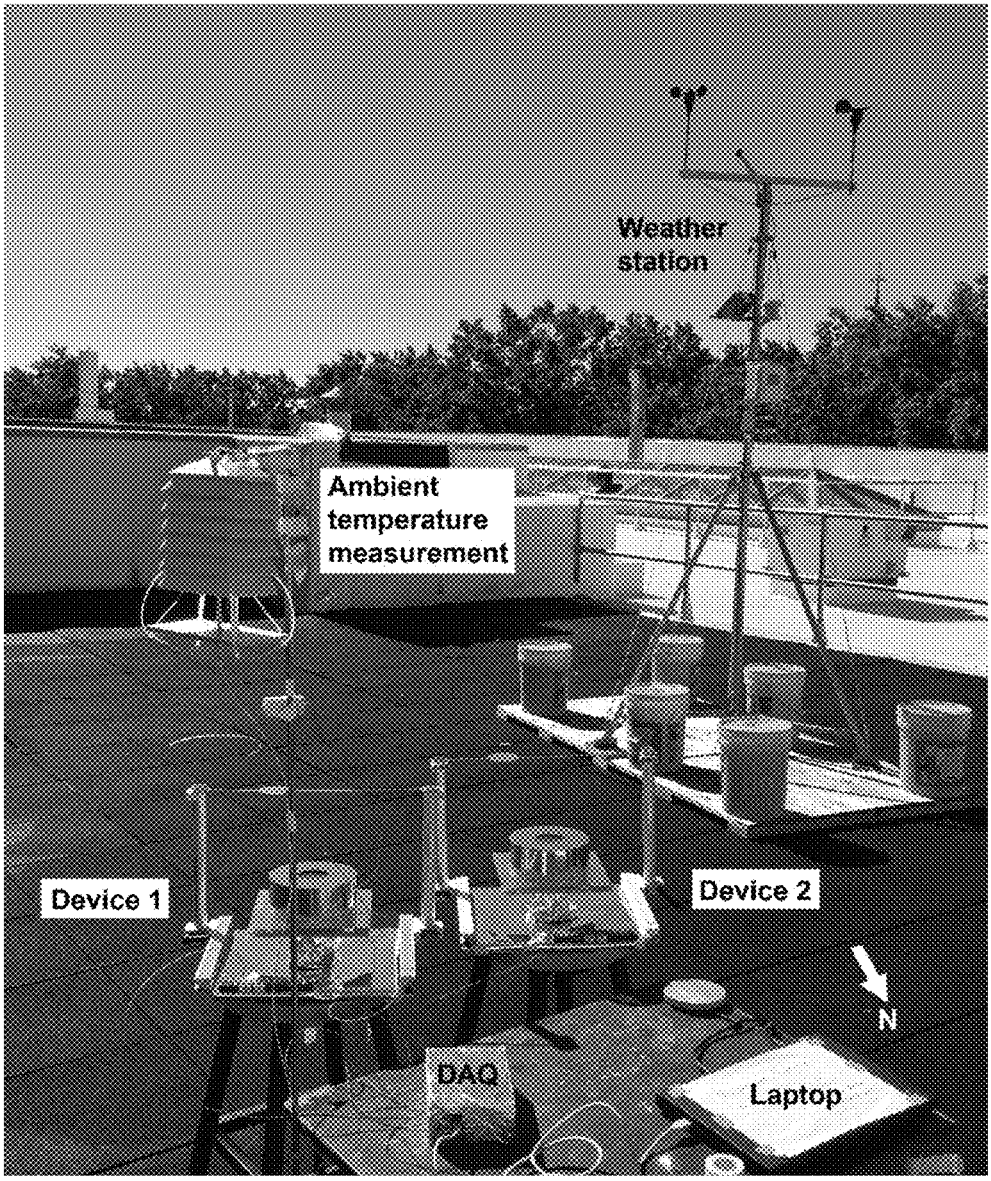
FIG. 6 depicts a measurement setup. Images of the rooftop measurement setup show the devices, data acquisition and weather monitoring equipment.

FIG. 6 shows an image of the measurement setup used for outdoor measurements. The setup comprised of two devices, each consisting of a thin copper emitter attached with thermocouples (and Kapton heaters, connected to a source meter in a 4-wire configuration, for the cooling power measurement experiment—FIGS. 4A-4B) on the bottom side. Temperature data was acquired using a DAQ module (Measurement Computing USB-TC) connected to a laptop. The DAQ device was enclosed in an aluminum box covered with aluminum foil to minimize heating due to direct sunlight and maintain a relatively isothermal environment. The ambient temperature was measured using an exposed element RTD (Omega P-L-A-1/4-6-1/4-T-6) designed for accurate air temperature measurement. The RTD was suspended ~5 ft. above the ground inside a solar radiation shield that prevented heating due to solar radiation while allowing air flow. Figure S2 also shows the weather station in the background that was used for weather monitoring during the course of the experiment (refer to Section 6 for more details). A separate pyrheliometer and pyranometer assembly mounted on a high-precision 2-axis solar-tracker was also installed on the rooftop (not shown in the FIG. 6), with the two sensors always aligned towards the sun. These sensors were used to measure the direct normal irradiance (DNI) and global tilted irradiance (GTI).

Section 4: Device COMSOL Modeling

Figure 7A:
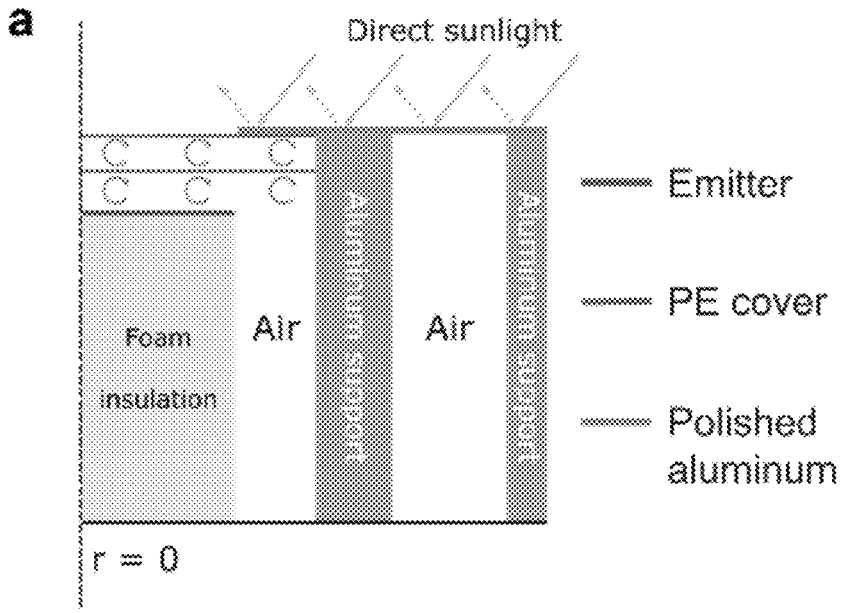
FIGS. 7A-7B depict theoretical simulation of the temperature distribution of the device.
Figure 7B:
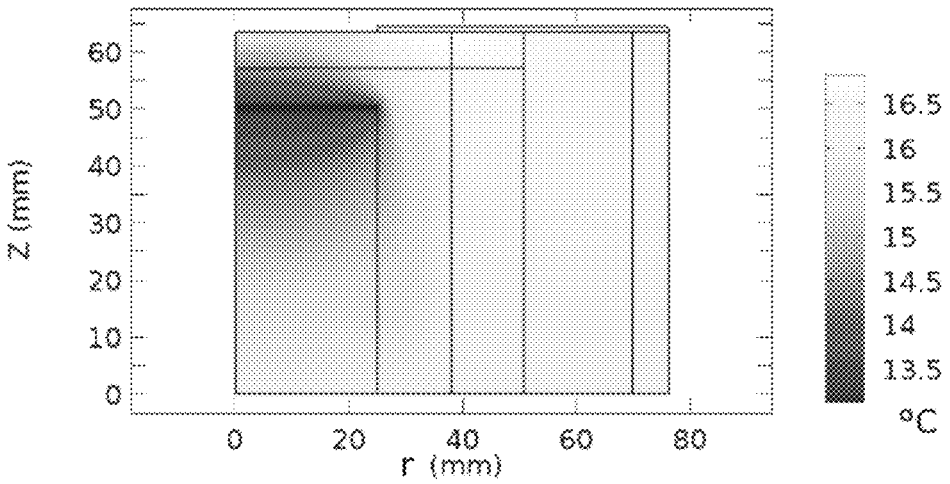

To understand the temperature distribution of the device, a theoretical model was built using COMSOL to simulate the heat transfer mechanism of the device. The model is shown in FIG. 7A, where the geometry of each component matches the real device. A conjugate conduction and natural convection heat transfer model was used to capture both conduction in solid materials and natural convection in air gaps. The heating effect of the direct sunlight incident on the aluminum cover was included by using the solar absorption of the polished aluminum (0.2). Other external boundary conditions were defined using convection correlations with respect to the ambient temperature. Heat conduction loss through heater wires was also estimated and included in the heat transfer coefficient calculation. An example of the simulated steady-state temperature distribution of the device is shown in FIG. 7B, when the emitter cooling power is 20 $W/m^2$ and the ambient temperature is 16° C. The predicted steady-state emitter temperature is 13° C., which matches our experimental results under similar conditions (FIG. 4B).

Section 5: Non-Tracking, Low Density Polyethylene Experiment

Figure 8A:
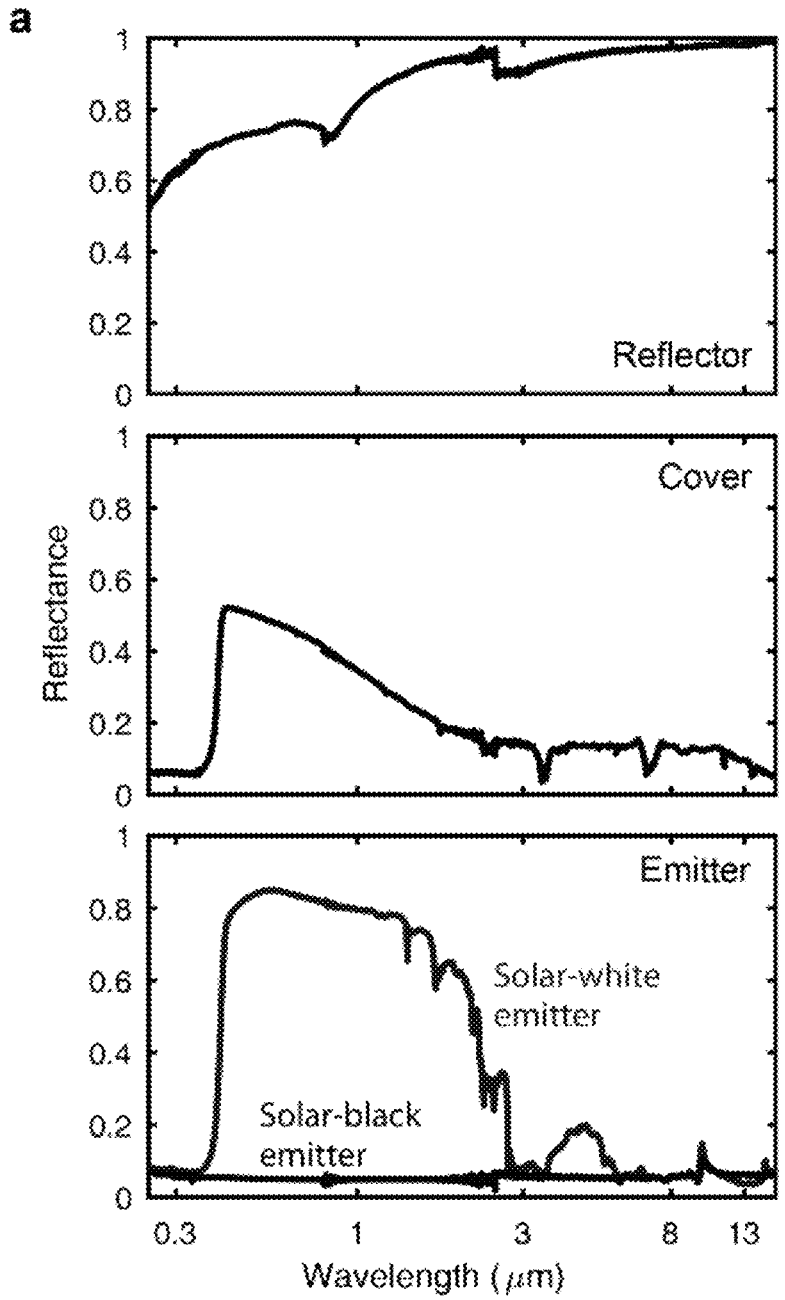
FIGS. 8A-8C depict stagnation temperature measurement using a non-solar-tracking setup.
Figure 8B:
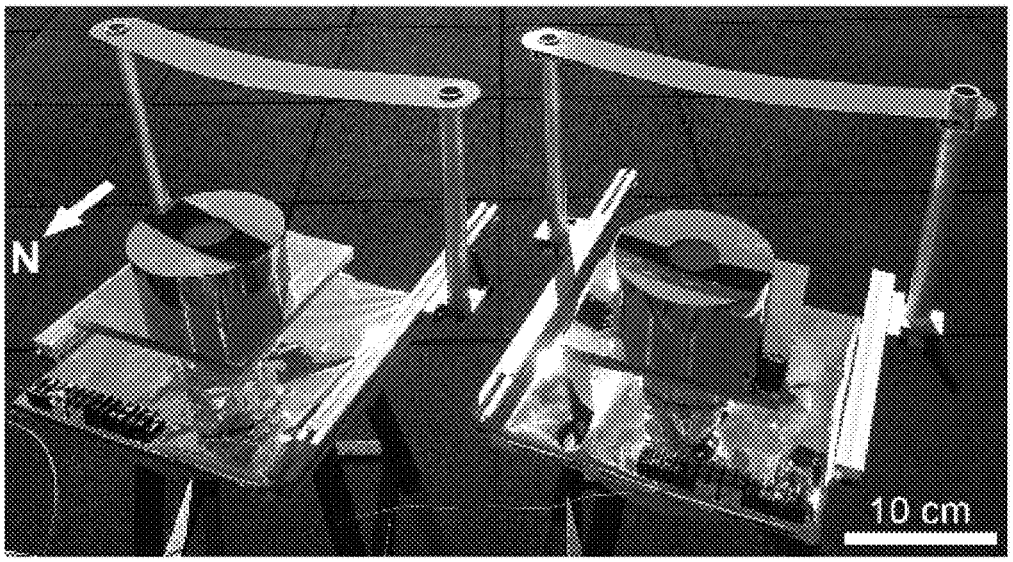
Figure 8C:
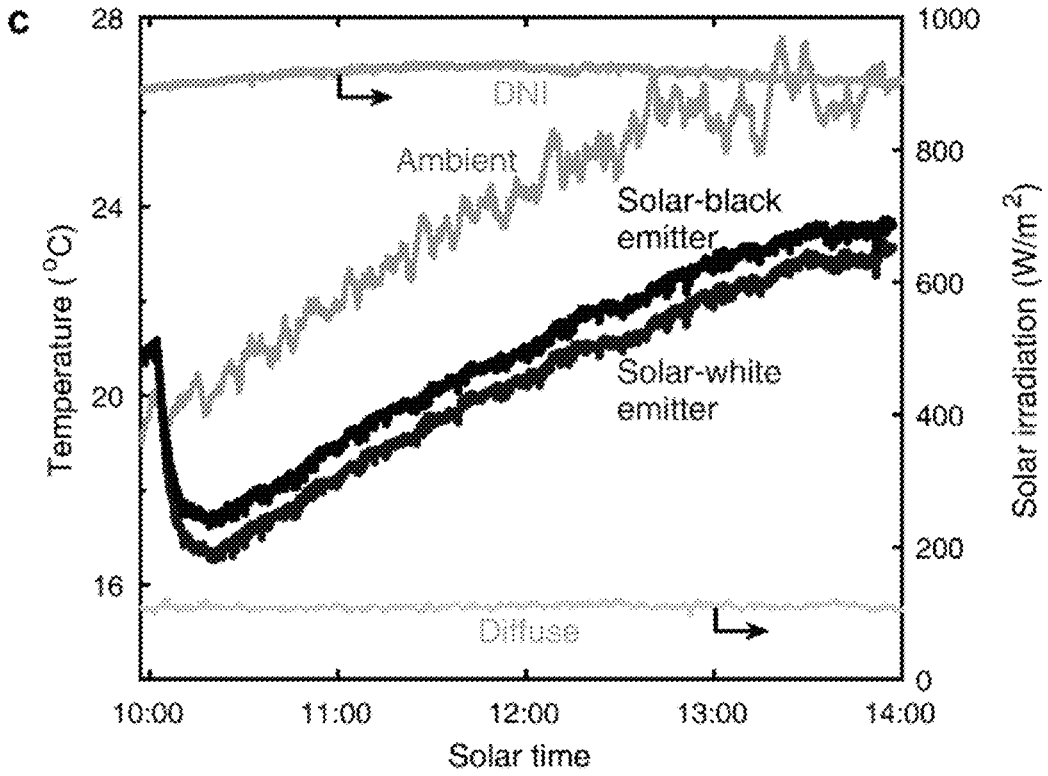

The device configuration was modified to demonstrate the possibility of sub-ambient passive cooling without solar tracking (FIGS. 8A-8C). The disk-type reflector (60 mm diameter) that required adjustment with changing sun position (FIGS. 2A-2B) was replaced with a band-type direct-solar reflector of the same width as the disk-reflector diameter. The shape of the band reflector was determined using the solar-reflector tracking algorithm utilized to calculate the track path for the disk-type solar reflector (described in the Methods section). In addition, to demonstrate the possibility of achieving sub-ambient daytime cooling using common household materials, we replaced the 2-layer nanoporous polyethylene cover with a cover made using two layers of white low-density polyethylene (LDPE, each ~50 μm thick) taken from a grocery bag. FIG. 8A shows the spectral reflectance of the double-layer LDPE convection cover—the solar-weighted reflectance was 39% and an average transmittance was 67% in the atmospheric window, in comparison with double-layer nanoporous polyethylene with 55% solar reflectance and 92% atmospheric-window transmittance. The rest of the setup, including the solar-white and solar-black emitters, was the same as shown in FIGS. 2A-2B.

To demonstrate the cooling performance of the modified setup with the band reflector and white LDPE cover grocery bag, we performed a stagnation temperature measurement around solar noon using the same procedure discussed with regard to FIG. 3. FIG. 8C shows the results of the stagnation temperature measurement. The average reduction of the device stagnation temperature was ≈4° C. below the ambient temperature and the solar-white emitter was cooler than the solar-black emitter by ≈0.4° C. The measured stagnation temperature reduction using the modified setup was comparable to the ≈5° C. cooling achieved using the setup used in FIGS. 2A-2B. The slight reduction in performance can be partly attributed to the lower solar reflectance and lower atmospheric-window transmittance of the LDPE cover which increased the contribution of the diffuse solar radiation and reduced the net outgoing mid-IR radiation. Further reduction in the cooling power was due to the larger solid angle subtended by the band-type direct-solar reflector on the emitter (as compared to the disk-type reflector) which reduced the angular domain available for mid-IR emission and increased the radiation emitted by the reflector towards the emitter. Overall the significant reduction of device temperature even with this sub-optimal setup made using readily available household materials demonstrates the ease of implementation and potential of this approach.

Section 6: Weather Data for all Measurements

Figure 9A:
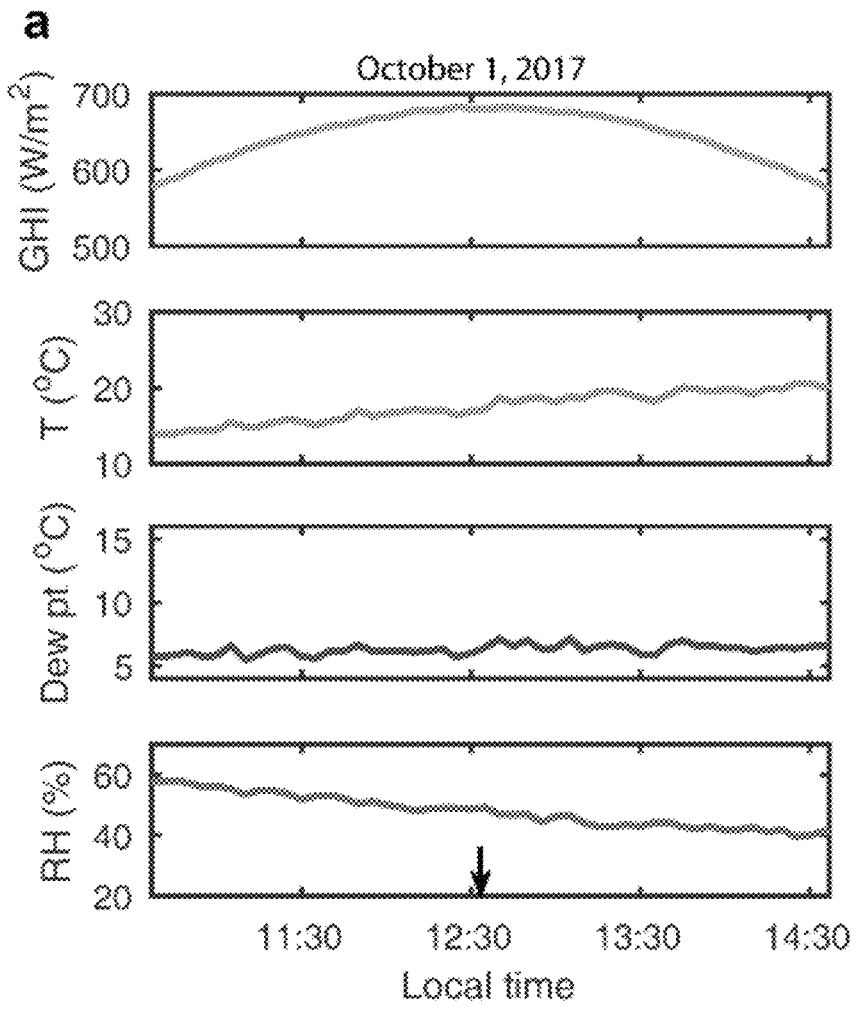
FIGS. 9A-9C depict weather parameters including global horizontal irradiance, ambient temperature, dew point and relative humidity measured during the course of measurements shown in FIGS. 3, 8C and 4A. The x-axis shows the local time and the downward pointing arrow represents solar noon. Measurement location: Cambridge, MA.
Figure 9B:
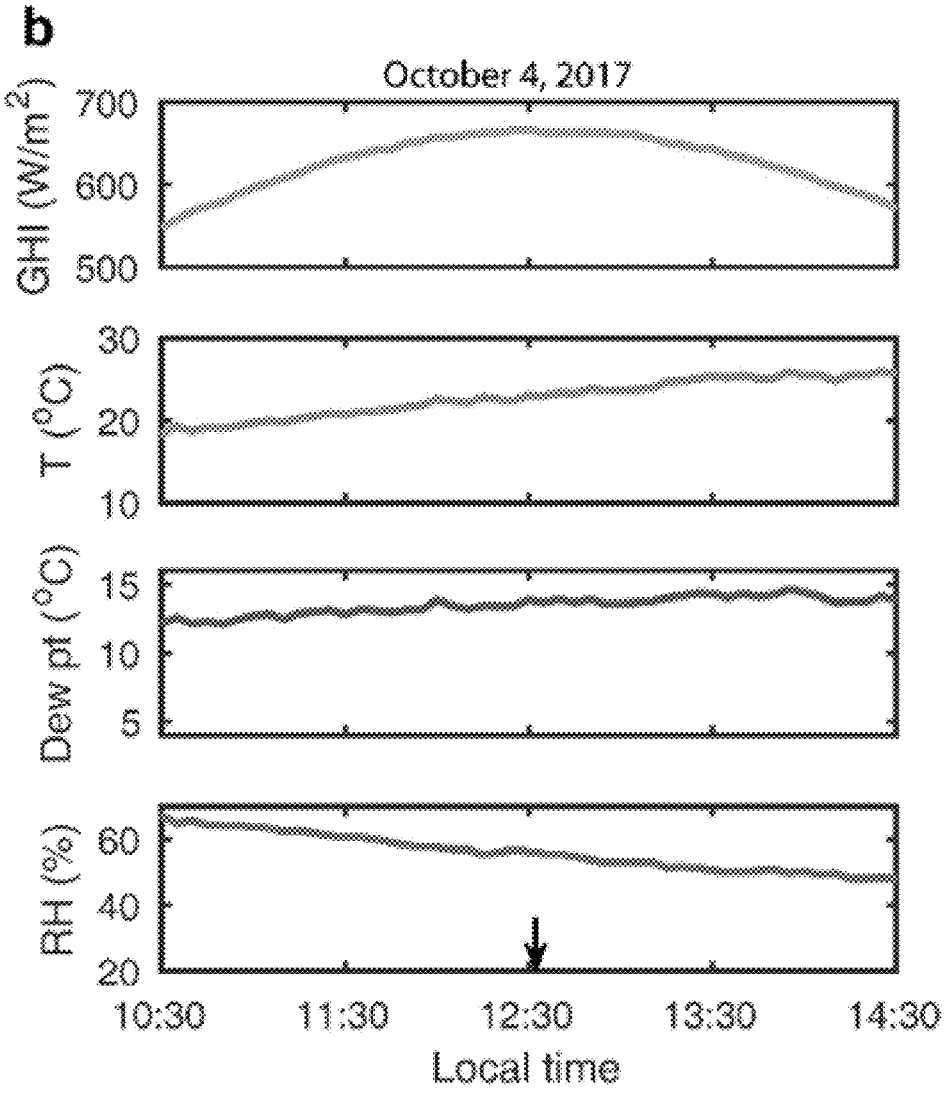
Figure 9C:
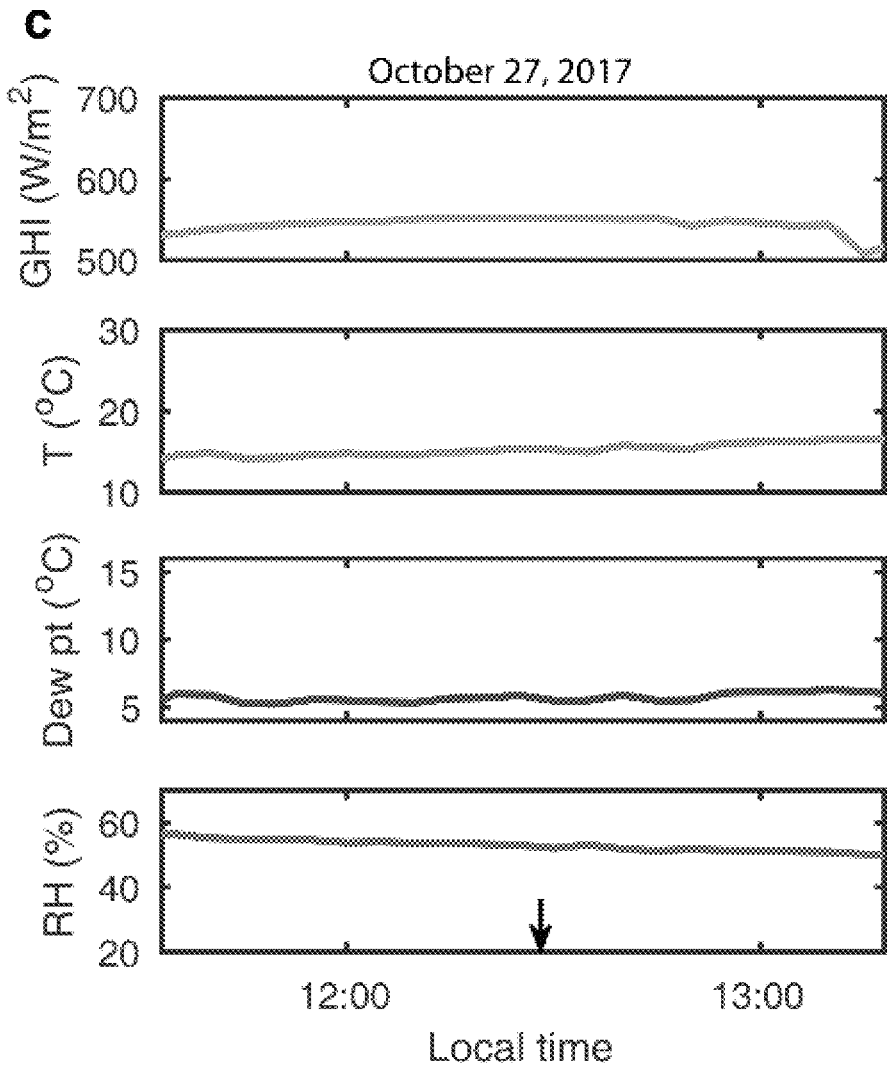

A weather station (HOBO U30 Weather Station) installed on the rooftop (same location as the experimental setup) was used for weather monitoring. The weather station measured the global horizontal irradiance (GHI, using a pyranometer sensor), ambient air temperature, dew point and relative humidity. The data acquisition frequency was set at 5 minutes. FIG. 9 shows the measured weather parameters during the course of measurements reported in FIGS. 3, 8C and 4A.

Other embodiments are within the scope of the following claims.

What is claimed is:

1. A radiative cooling device comprising:

an emitter enclosed in a housing and in thermal communication with atmosphere;

and a reflector mounted on a track suspended above the emitter and capable of being moved along the track to block solar radiation from the emitter.

2. The device of claim 1, wherein the housing has an opening, the opening having a cover.

3. The device of claim 2, wherein the cover is partially transparent in an atmospheric wavelength transparency window.

4. The device of claim 3, wherein the cover is partially transparent in an atmospheric wavelength transparency window and partially reflective in a solar wavelength window, thereby minimizing heat gain due to diffuse solar radiation.

5. The device of claim 3, wherein the cover includes a nanoporous polyolefin.

6. The device of claim 1, wherein the emitter is partly absorbing in the solar wavelength spectrum.

7. The device of claim 1, wherein the emitter is partly reflecting in the solar wavelength spectrum.

8. The device of claim 1, wherein the reflector is a disc, the disc being positionable to substantially block direct solar radiation from the emitter.

9. The device of claim 8, wherein the reflector is positioned in a first dimension and a second dimension relative to the emitter based on the location of the sun.

10. The device of claim 1, wherein the reflector is a band, the band being positionable to substantially block direct solar radiation from the emitter.

11. The device of claim 10, wherein the reflector is positioned in a first dimension relative to the emitter based on the location of the sun.

12. A method of radiative cooling using the device of claim 1, the method comprising:

moving the reflector along the track to substantially block direct solar radiation from the emitter.

13. The method of claim 12, wherein the housing has an opening, the opening having a cover.

14. The method of claim 12, wherein the cover is partially transparent in an atmospheric wavelength transparency window and partially reflective in a solar wavelength window, thereby minimizing heat gain due to diffuse solar radiation.

15. The method of claim 12, wherein the cover is partially transparent in an atmospheric wavelength transparency window and partially reflective in a solar wavelength window, thereby minimizing heat gain due to diffuse solar radiation.

16. The method of claim 15, wherein the cover includes a nanoporous polyolefin.

17. The method of claim 12, wherein the emitter is partly absorbing in the solar wavelength spectrum.

18. The method of claim 12, wherein the emitter is partly reflecting in the solar wavelength spectrum.

19. The method of claim 12, wherein the reflector is a disc, the disc being positioned in a first dimension and a second dimension relative to the emitter based on the location of the sun.

20. The method of claim 12, wherein the reflector is a band, the band being positioned a first dimension relative to the emitter based on the location of the sun.

* * * * *